US009494036B2

(12) United States Patent
Han

(10) Patent No.: US 9,494,036 B2
(45) Date of Patent: Nov. 15, 2016

(54) UNMANNED INTELLIGENT MINING MACHINE

(71) Applicant: Xinping Han, Fuxin (CN)

(72) Inventor: Xinping Han, Fuxin (CN)

( * ) Notice: Subject to any disclaimer, the term of this patent is extended or adjusted under 35 U.S.C. 154(b) by 0 days.

(21) Appl. No.: 14/308,832

(22) Filed: Jun. 19, 2014

(65) Prior Publication Data

US 2015/0275665 A1 Oct. 1, 2015

(30) Foreign Application Priority Data

Mar. 28, 2014 (CN) ..... 2014 1 0123925

(51) Int. Cl.

| | |
|---|---|
| ***E21C 35/24*** | (2006.01) |
| ***E21C 25/52*** | (2006.01) |
| ***E21C 35/08*** | (2006.01) |
| ***E21C 25/06*** | (2006.01) |
| ***E21D 9/10*** | (2006.01) |
| ***E21D 9/11*** | (2006.01) |

(52) U.S. Cl.

CPC ..... *E21C 35/24* (2013.01); *E21C 25/06* (2013.01); *E21C 25/52* (2013.01); *E21C 35/08* (2013.01); *E21D 9/1013* (2013.01); *E21D 9/113* (2013.01)

(58) Field of Classification Search

CPC ..... E21C 35/10; E21C 35/24

See application file for complete search history.

(56) References Cited

U.S. PATENT DOCUMENTS

| | | | | |
|---|---|---|---|---|
| 4,014,574 | A * | 3/1977 | Todd | 299/1.4 |
| 4,889,392 | A * | 12/1989 | Justice | E21C 27/22 299/18 |
| 5,072,994 | A * | 12/1991 | Brandl et al. | 299/67 |
| 5,582,466 | A * | 12/1996 | Delli-Gatti, Jr. | 299/18 |
| 5,863,101 | A * | 1/1999 | Seear | 299/68 |
| 6,270,163 | B1 * | 8/2001 | Mullet et al. | 299/75 |
| 2006/0038438 | A1 * | 2/2006 | Mraz | 299/30 |

* cited by examiner

*Primary Examiner* — John Kreck

(74) *Attorney, Agent, or Firm* — Fredrikson & Byron, P.A.

(57) ABSTRACT

The present invention relates to the field of mining machines, particularly to an unmanned intelligent mining machine. The unmanned intelligent mining machine comprises a cutting part body, a reciprocating telescoping device and a deployable flank cutting device, wherein the reciprocating telescoping device is used to drive a cutting drum to reciprocate back and forth, and the deployable flank cutting device can be deployed toward flanks of the cutting part body and cuts the orebody in the direction of the flanks. When the unmanned intelligent mining machine retreats, the deployable flank cutting device is deployed toward both sides of the cutting part body. After deployed, the deployable flank cutting device forms a certain angle with the longitudinal direction of the cutting part body, and can cut the orebodies on both sides simultaneously, forming a caving face on both sides of the roadway, and increasing the mining amount of unmanned intelligent mining machine.

5 Claims, 7 Drawing Sheets

UNMANNED INTELLIGENT MINING MACHINE

TECHNICAL FIELD

The present invention relates to the field of mining machines, particularly to an unmanned intelligent mining machine.

BACKGROUND ART

Slope exploitation constitutes important part of mineral mining. After disposing an slope mining machine on the open area or abench in front of an slope of an orebody to be exploited, the orebody in complicated condition, such as being horizontal or inclined and the like, may be exploited. The slope mining machine moves forward, driving a cutting drum to enter the orebody for cutting. The cut mineral is carried out from roadway by a delivery system, transported to the external side-by ground for stacking, eventually a series of parallel roadways with rectangular cross section are formed at the exploiting end-slop.

Since the cutting drum is pushed into the orebody by the mining machine which can only be advanced linearly, the existing slope mining machine can only cut the orebody directly in front of it, and directly exit the roadway when retreating, the mining amount being small.

DISCLOSURE OF THE INVENTION

The object of the present invention provides an unmanned intelligent mining machine to solve the above mentioned problems.

An embodiment of the present invention provides an unmanned intelligent mining machine, comprising a cutting part body, a reciprocating telescoping device and a deployable flank cutting device, wherein the reciprocating telescoping device is used to drive a cutting drum to reciprocate back and forth, and the deployable flank cutting device can be deployed toward flanks of the cutting part body and cuts the orebody in the direction of the flanks.

Preferably, the reciprocating telescoping device comprises a sliding stage and a first power device, wherein the sliding stage slidably coordinates with the cutting part body, the first power device is fixed on the cutting part body and used for driving the sliding stage to slide, and the cutting drum is disposed on the sliding stage.

Preferably, the deployable flank cutting device comprises a flank power device and a flank cutting device, wherein the flank cutting device is collapsed into the sliding stage along the longitudinal direction of the sliding stage, and the flank power device is used to drive the flank cutting device to be deployed toward both sides of the sliding stage to a position forming a certain angle with the longitudinal direction of the sliding stage.

Preferably, a plurality of groups of distance detection devices and hydraulic supporting rods are provided on both sides of the cutting part body, wherein the plurality of groups of distance detection devices are used to detect the distance from both side walls of the roadway, wherein if the difference between the distances from both sides is greater than a predefined value, the hydraulic supporting rods at the side of smaller distance extend and abut against the side wall of the roadway, and thus the direction of the cutting part is corrected by reaction force.

Further, the unmanned intelligent mining machine further comprises a plurality of unpowered docking transportation devices (jointed), each unpowered docking transportation device comprising a transporter, a through-shaft and a power transmission device, wherein the through-shaft runs through the unpowered docking transportation devices, and both ends of the through-shaft are provided with docking portions for docking with the cutting part body and/or the previous unpowered docking transportation device and/or the next unpowered docking transportation device; and the power transmission device is used to transmit the rotation power from the through-shaft to the transporter.

Compared with the prior art, in the unmanned intelligent mining machine provided by embodiments of the present invention, during mining, the cutting drum extends forwardly by the reciprocating telescoping device, that is to say, the cutting part body of the unmanned intelligent mining machine is stationary, while the cutting drum is pushed forward and cuts the orebody. In addition, when the unmanned intelligent mining machine retreats, the deployable flank cutting device deploys toward both sides of the cutting part body. After deployed, the deployable flank cutting device forms an angle with the longitudinal direction of the cutting part body, then during the unmanned intelligent mining machine retreating backward, the deployable flank cutting device can cut the orebodies on both sides simultaneously, forming a caving faces on both sides of the roadway, and increasing the mining amount of unmanned intelligent mining machine.

DETAILED DESCRIPTION OF THE PREFERRED EMBODIMENTS

The present invention will be further described in detail below through specific embodiments in conjunction with the figures.

Figure 3:
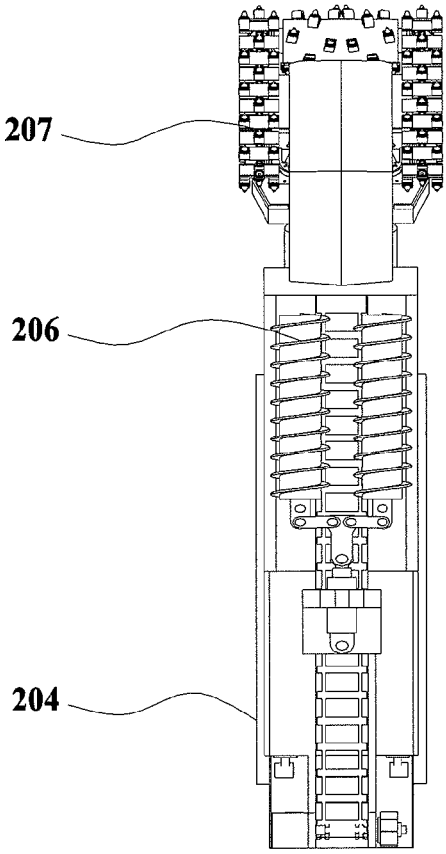
FIG. 3 shows a top view of a deployable flank cutting device according to an embodiment of the present invention.
Figure 4:
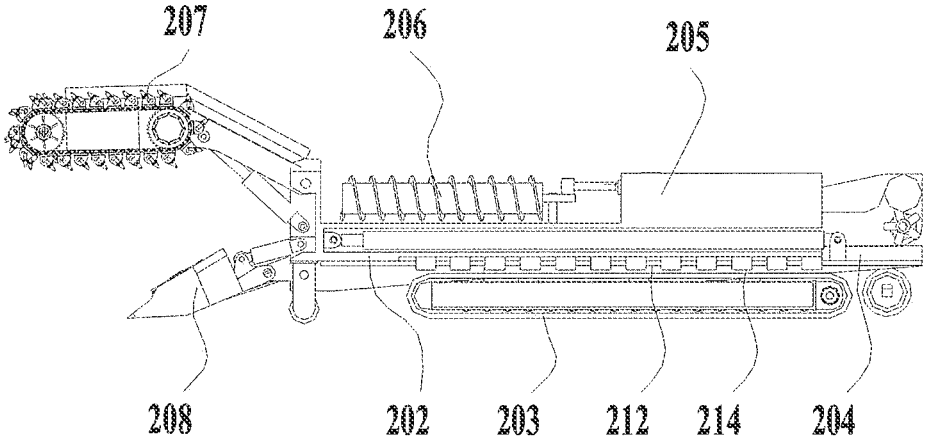
FIG. 4 shows a side view of the deployable flank cutting device according to an embodiment of the present invention.
Figure 5:
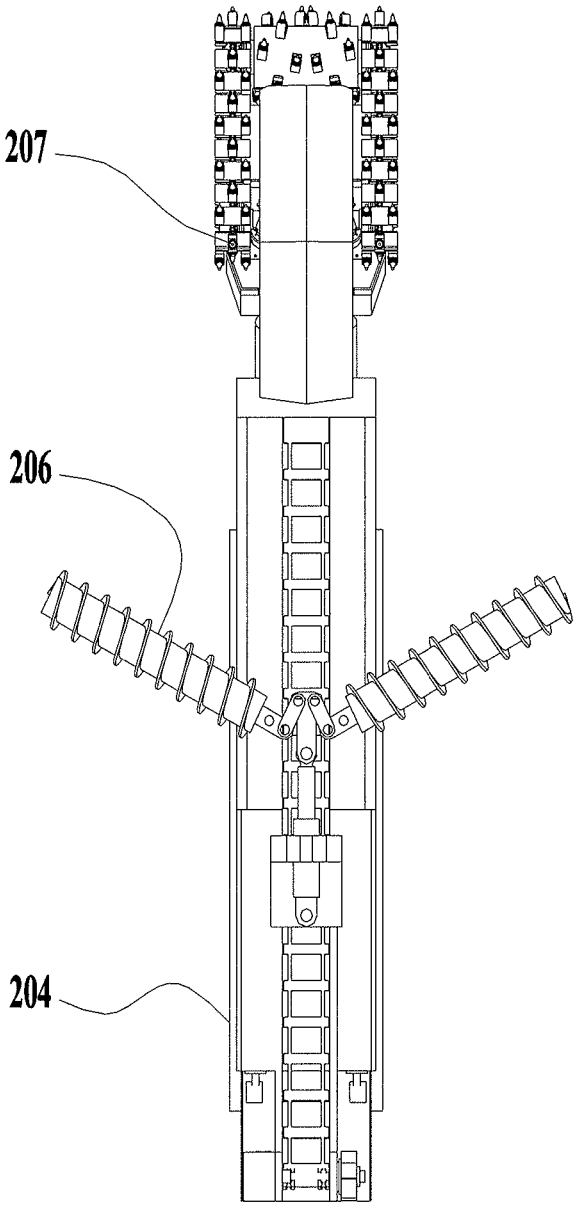
FIG. 5 shows a deployed schematic view of the deployable flank cutting device according to an embodiment of the present invention.

As shown in FIGS. 3, 4 and 5, the present embodiment provides an unmanned intelligent mining machine, which comprises a cutting part body 204, a reciprocating telescoping device 202 and a deployable flank cutting device 206. The reciprocating telescoping device 202 is used to drive a cutting drum 207 to reciprocate back and forth. The deployable flank cutting device 206 may be deployed toward flanks of the cutting part body 204 and cuts the orebody in the direction of the flanks.

Compared with the prior art, in the unmanned intelligent mining machine provided by the embodiment of the present invention, during mining, the cutting drum 207 extends forwardly by the reciprocating telescoping device 202, that is to say, the cutting part body 204 of the unmanned intelligent mining machine is stationary, while the cutting drum 207 is pushed forward and cuts the orebody, wherein the cutting drum 207 of the present embodiment may be selected from any cutting drum available in the current market. In addition, when the unmanned intelligent mining machine retreats, the deployable flank cutting device 206 deploys toward both sides of the cutting part body 204. After deployed, the deployable flank cutting device 206 forms a certain angle with the longitudinal direction of the cutting part body 204, then during the unmanned intelligent mining machine retreating backward, the deployable flank cutting device 206 can cut the orebodies on both sides simultaneously, forming a caving face on both sides of the roadway, and increasing the mining amount of unmanned intelligent mining machine.

Figure 8:
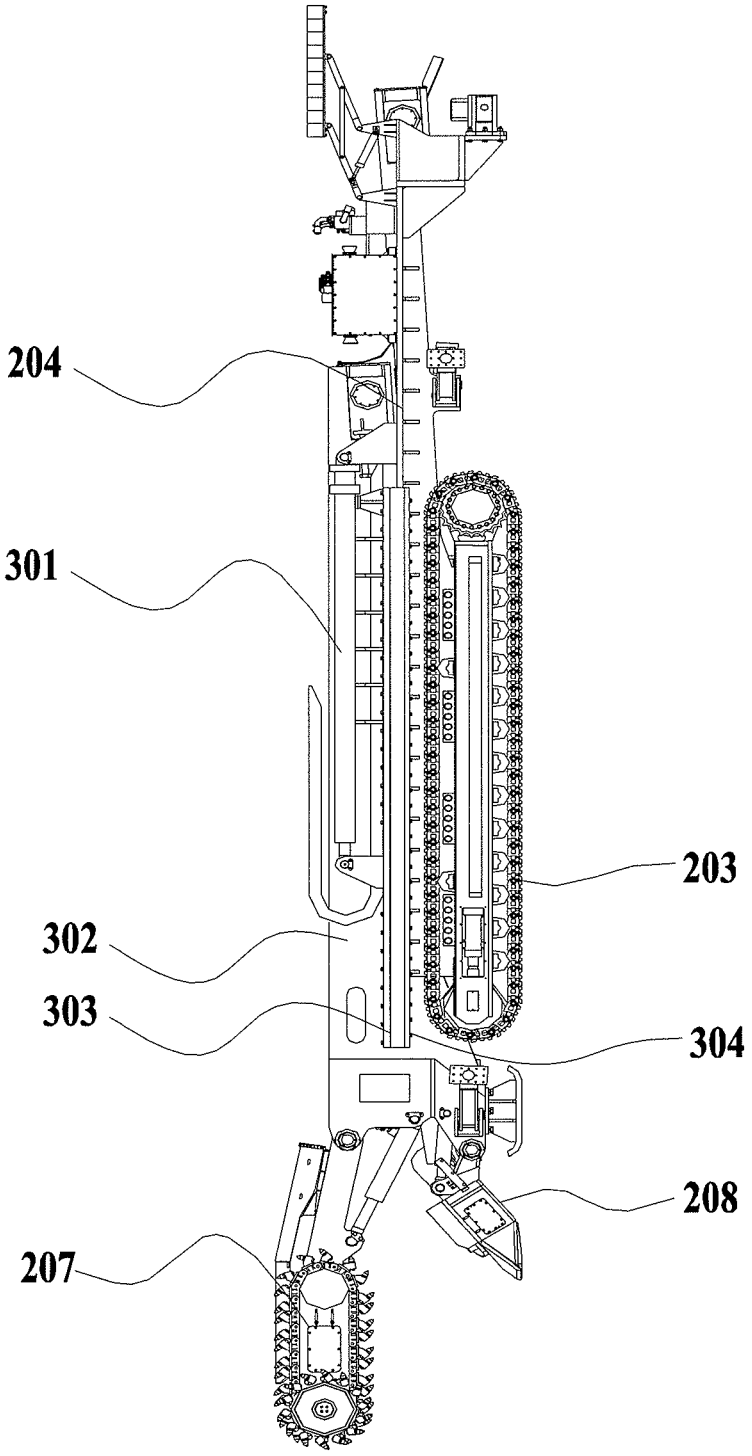
FIG. 8 shows a side view of an unmanned intelligent mining machine according to an embodiment of the present invention.

Furthermore, as shown in FIG. 8, the reciprocating telescoping device of the present embodiment comprises a sliding stage 302 and a first power device 301, wherein the sliding stage 302 slidably coordinates with the cutting part body 204, the first power device 301 is fixed on the cutting part body 204 and used to drive the sliding stage 302 to slide, and the cutting drum 207 is disposed on the sliding stage 302. Specifically, the first power device 301 may be a telescopic oil cylinder, piston rod of which is telescopic. Since the piston rod is fixed to the sliding stage 302, and the sliding stage 302 slidably coordinates with the cutting part body 204, the telescoping of the piston rod will drive the sliding stage to slide on the cutting part body. When sliding, the sliding stage 302 will drive the cutting drum 207 to reciprocate.

Preferably, a sliding slot 303 is provided on the sliding stage 302, a rail 304 is provided on the cutting part body 204, and the sliding slot 303 slidably coordinates with the rail 304. That is, the sliding of the cutting part body 204 with respect to the sliding stage 302 is achieved through the rail, with good guidance and good stability.

Figure 9:
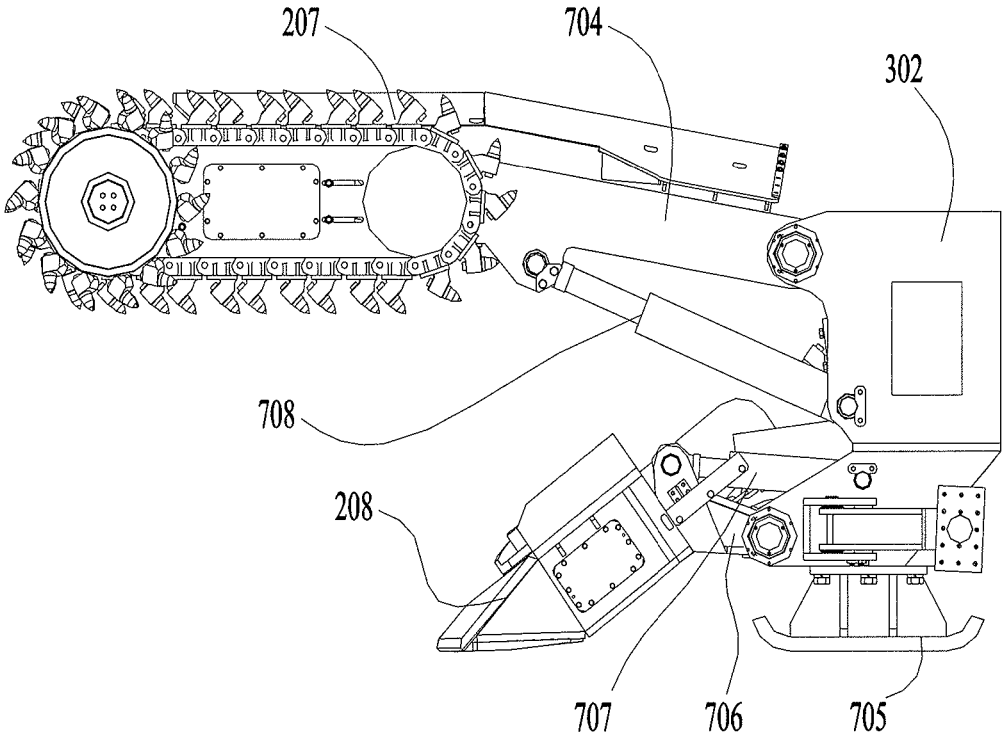
FIG. 9 shows a side view of a cutting drum according to an embodiment of the present invention.

Further, as shown in FIG. 9, the unmanned intelligent mining machine further comprises a loading device 208, a third swinging arm 706 and a third telescopic oil cylinder 707. One end of the third swinging arm 706 is connected with the loading device 208, and the other end thereof is hinged to the lower portion of the front end of the sliding stage 302. The fixed end of the third telescopic oil cylinder 707 is hinged to the middle portion of the front end of the sliding stage 302, and the telescopic end of it is hinged to the swinging arm 706. Specifically, after the mineral cut by the cutting drum drops down, it will be collected by the loading device. The loading device may swing under the driving of the third telescopic oil cylinder, making the loading device 208.

positioned in proper position, in favor of collecting the mineral cut.

Furthermore, a second swinging arm 704 and a second telescopic oil cylinder 708 are hinged to the front end of the sliding stage 302, respectively. The other end of the second swinging arm 704 is fixed to the cutting drum 207, and a telescopic shaft of the second telescopic oil cylinder 708 is hinged to the second swinging arm 704. The telescoping of the second telescopic oil cylinder 708 may make the second swinging arm 704 swing up and down, so that the cutting drum 207 moves up and down and cuts the orebody in front of it. In addition, when the unmanned intelligent mining machine retreats, the second telescopic oil cylinder 708 raises the cutting drum 207, increasing the mining height of the cutting drum 207, and increasing the mining amount.

Further, the unmanned intelligent mining machine further comprises a sliding plate 705 located at the lower portion of the front end of the sliding stage 302, the sliding plate 705 abutting against the ground in the mine. Specifically, during the sliding stage 302 driving the cutting drum and the loading device 208 to reciprocate, due to the heavy weights of the cutting drum and the loading device 208, the sliding stage 302 might be deformed after the cutting drum and the loading device 208 extend for some distance. In order to avoid the sliding stage 302 from withstanding all the pressure from the cutting drum and the loading device, the sliding plate 705 is provided at the front end of sliding stage 302, the sliding plate 705 abuts against the ground. During the reciprocating of the sliding stage, the sliding plate is supported on the ground all the time and withstands most of the pressure from the cutting drum and the loading device, thereby avoiding the sliding stage from being deformed, and prolonging the service life of sliding stage.

Further, the unmanned intelligent mining machine further comprises a walking device 203 located at the lower portion of the cutting part body 204, the walking device 203 being a caterpillar. That is, the walking device 203 drives the cutting part body 204 to walk, and since the road condition in the mine is complex, the walking device is preferably a caterpillar.

Further, the unmanned intelligent mining machine further comprises a delivery device located in the cutting part body 204. The mineral collected by the loading device is delivered out from the mine via the delivery device. Cutting, collection and delivery are integrated as a whole, improving the degree of automation of the unmanned intelligent mining machine.

Figure 6:
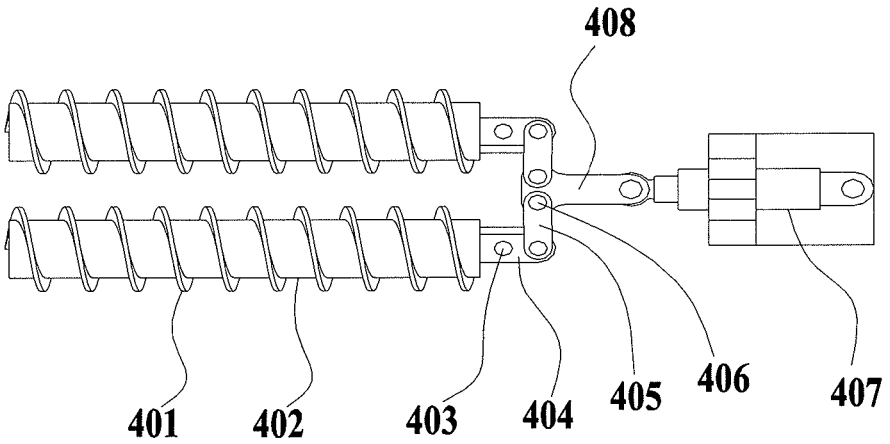
FIG. 6 shows a complete structural view of the deployable flank cutting device according to an embodiment of the present invention.
Figure 7:
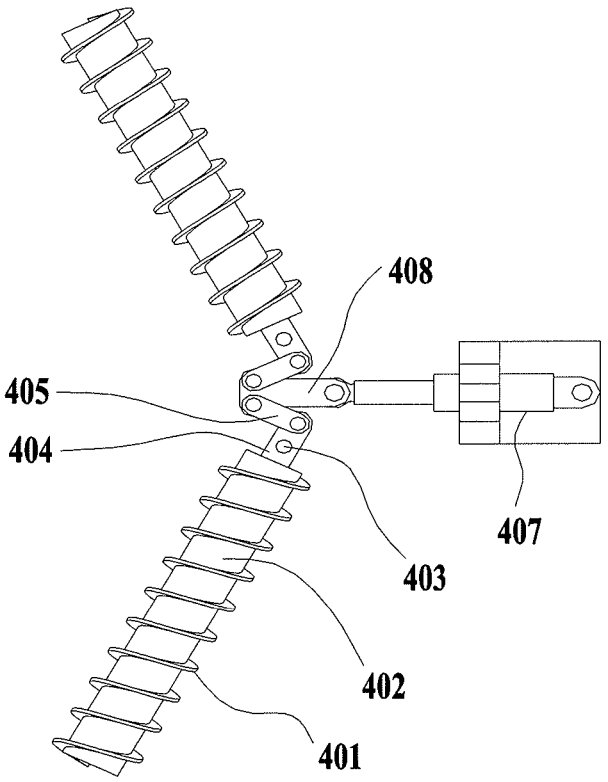
FIG. 7 shows a complete structural view of the deployable flank cutting device according to an embodiment of the present invention, which is deployed.

Further, as shown in FIGS. 6 and 7, the deployable flank cutting device 206 comprises a flank power device 205 and a flank cutting device. The flank cutting device is collapsed in the sliding stage 302 along the longitudinal direction of the sliding stage 302, and the flank power device 205 is used to drive the flank cutting device to be deployed toward both sides of the sliding stage to a position forming a certain angle with the longitudinal direction of the sliding stage.

That is, the flank cutting device and the flank power device 205 are mounted on the sliding stage 302. When the sliding stage 302 retreats, the flank power device 205 may drive the flank cutting device to be deployed toward both sides of the sliding stage 302. After be deployed, the flank cutting device forms a certain angle with the longitudinal direction of the sliding stage. During the retreating of the sliding stage, the flank cutting drum can cut the orebodies on both sides simultaneously, forming a caving face and a caving area on both sides of the unmanned intelligent mining machine, and the mineral in the caving area can continue to cave, increasing the mining amount of unmanned intelligent mining machine.

Specifically, as to the particular structure of the flank cutting device, preferably, as shown in FIGS. 6 and 7, the flank cutting device comprises two flank cutting drums 402 and two drum shafts 404. The two flank cutting drums 402 are sleeved over the two drum shafts 404, respectively; a first hinging portion 403 is provided on each of the two drum shafts 404; the two first hinging portion 403 are hinged to the sliding stage 302, respectively, and the tail parts of the two drum shafts 404 cooperate with the flank power device 205, respectively; the flank power device 205 is used to push the tail parts of the two drum shafts 404, causing the two drum shafts 404 to rotate reversely around the two first hinging portions 403, respectively. Specifically, the two flank cutting drums be deployed toward both sides of the sliding stage, respectively, the power resource thereof derived from the flank power device. When the two flank cutting drums are collapsed in the sliding stage, the two drum shafts may be arranged along the longitudinal direction of the sliding stage. Then the flank power device pushes the two drum shafts, respectively, making one of them to rotate around one of the first hinging portions, and the other one to rotate reversely around the other first hinging portion, thus the two flank cutting drums be deployed outwards, wherein cutting teeth 401 may spirally provided outside the flank cutting drums 402.

As to the particular structure of the flank power device driving the two drum shafts to rotate reversely, preferably, the flank cutting device further comprises two joint shafts 405. One ends of the two joint shafts 405 are fixedly connected to the tail parts of the two drum shafts 404, respectively, and the other ends of the two joint shafts 405 cooperate with the flank power device 205, respectively, wherein the joint shaft 405 forms a certain angle with the drum shaft 404, the angle capable of being an acute angle, obtuse angle or right angle, and the shape of "L" is formed between the joint shaft and the drum shaft when the angle is right angle. That is, the two drum shafts are parallel with each other when they are arranged along the longitudinal direction of the sliding stage, while the two joint shafts fixedly connected to the two drum shafts, at the connection between the two joint shafts, bend between the two drum shafts, and the flank power device may drive in one direction, thus causing the two drum shafts to rotate in opposite directions. Of course, the present embodiment is not limited to this structure, and other structures may be employed to achieve the same function.

Preferably, the flank power device 205 comprises a telescopic device 407 and a telescopic bracket 408. One end of the telescopic bracket 408 is connected to a telescopic shaft of the telescopic device 407, and the other end thereof is provided with two second hinging portions 406; the two second hinging portions 406 are hinged to the ends of the two joint shafts 405, respectively. As to the telescopic bracket 408, the two second hinging portions 406 are located at both sides of the central axis of the telescopic bracket 408, respectively. When the telescopic shaft of the telescopic device 407 pushes the telescopic bracket 408 along the longitudinal direction of the sliding stage, the telescopic bracket 408 may divide the pushing force into the forces applied to two joint shafts 405. The pushing force applied to the joint shaft 405 may forms a certain angle with the joint shaft 405, wherein when the angle between the joint shaft 405 and the drum shaft 404 is 90°, the angle between the pushing force and the joint shaft 405 is 90°, thus causing the drum shaft 404 to rotate around the first hinging portions 403.

Preferably, a hydraulic motor is provided in each of the two flank cutting drums. That is, after the flank cutting drums being deployed, the hydraulic motors located inside the flank cutting drums drive the flank cutting drums to rotate, making the orebodies on both sides of the cutting part body to be cut, accelerating the caving of the orebody.

In order to facilitate the collection of the mineral cut from the flanks, preferably, after the flank cutting device be deployed, its tail part is located on the sliding stage in which a transportation device is provided. That is, after the mineral is cut by the flank cutting drums, it may be collected directly by the transportation device in the sliding stage, and the mineral cut from the flanks may be delivered by the transportation device in the sliding stage to the delivery system, and further delivered outside of the roadway (mine).

The unmanned intelligent mining machine according to the embodiment of the present invention further comprises a plurality of jointed unpowered docking transportation devices, each unpowered docking transportation device comprising a transporter, a through-shaft and a power transmission device. The through-shaft runs through the unpowered docking transportation devices, and both ends of the through-shaft are provided with docking portions for docking with the cutting part body and/or the previous unpowered docking transportation device and/or the next unpowered docking transportation device; and the power transmission device is used to transmit the rotation power from the through-shaft to the transporter.

There is no power apparatus in the unpowered docking transportation devices, the power of which is transmitted from an outside power apparatus via the docking portions of the through-shaft, preferably, the power is provided by the cutting part body of the present invention. After the rotation power is transmitted by the cutting part body to the through-shaft, the through-shaft on one hand transmits the power to the transporter via the power transmission device, on the other hand docks with the next adjacent unpowered docking transportation device via the docking portion of the through-shaft, thus transmitting the rotation power, making the delivery speed of each unpowered docking transportation device synchronous, and avoiding the materials accumulation on the unpowered docking transportation devices.

As to the particular structure of the power transmission device, preferably, the power transmission device comprises a driving bevel gear 106, a driven bevel gear and a sprocket. The driving bevel gear 106 is fixed on the through-shaft and engages with the driven bevel gear; the sprocket is driven coaxially with the driven bevel gear and is connected to a driving drum 109 of the transporter via a chain, wherein the driving bevel gear is fixed on the through-shaft and rotates along with the rotation of the through-shaft, since the driving bevel gear 106 engages with the driven bevel gear, the rotating driving bevel gear 106 transmits the power to the driven bevel gear, which transmits the power to the sprocket which is driven coaxially with it. The sprocket is connected to the driving drum 109 of the transporter via the chain, and specifically, a driven sprocket is provided coaxially on the driving drum 109, and then the chain transmits the rotation power of the sprocket to the driven sprocket, thus making the driving drum rotating, and delivering materials.

It should be noted that the power transmission device of the present embodiment is not limited to the above mentioned structure, but also can be the following mechanism. For example, a pulley is provided on the driving drum, and what is driven coaxially with the driven bevel gear is a pulley as well, thus the power from the through-shaft may be transmitted to the driving drum via by belt cooperation. More simply, the pulley is directly fixed on the through-shaft, and then the power is transmitted to the driving drum via a cross belt. In addition, the power transmission device may also employ any structure which transmits the power from the through-shaft to the driving drum.

Only one through-shaft is employed to transmit the rotation power, while in actual workplace, only one through-shaft to transmit the power may cause instability of the power transmission due to the influence, such as vibration and other factors. In order to avoid such situation, the through-shaft of the present embodiment may be realized by employing the following structure.

Preferably, the through-shaft comprises a transmission shaft 101, a universal coupling 102 and an intermediate shaft 105. Both ends of the universal coupling 102 are connected to the transmission shaft 101 and the intermediate shaft 105, respectively. The driving bevel gear is fixed on the intermediate shaft. A plurality of walking wheels are provided at the bottom of a bracket of the unpowered docking transportation device, and the transporter, the through-shaft and the power transmission device are located in the bracket. Specifically, the docking portion at the head end of the through-shaft may be arranged at the one end of the transmission shaft, and the docking portion at the tail end of the through-shaft may be arranged at the tail end of the intermediate shaft, wherein the intermediate shaft may be arranged on the bracket through a bearing seat, and the transmission shaft may also be arranged on the bracket through a bearing seat, and the transmission shaft and the intermediate shaft are connected by the universal coupling. After the power is transmitted by the docking portion to the transmission shaft, since the transmission shaft and the intermediate shaft are connected by the universal coupling, it avoids dynamic balance of the intermediate shaft and transportation speed of the transporter from being affected by the power during the transmission.

In order to further improve the dynamic balance property of the intermediate shaft and ensure the rotation power being transmitted stably, the through-shaft further comprises a first connecting shaft 104 and a second connecting shaft 107. The first connecting shaft 104 is connected between the universal coupling 102 and the intermediate shaft 105, and the second connecting shaft 107 is connected to the tail end of the intermediate shaft 105 through a connecting sleeve. After the universal coupling transmits the rotation power to the first connecting shaft, since the first connecting shaft 104 may cause vibration together with the universal coupling 102 during the power transmission, in order to reduce such vibration, first connecting shaft 104 is provided between the intermediate shaft 105 and the universal coupling 102, thus making the rotation of the intermediate shaft 105 more stable. As to the second connecting shaft 107, in order to avoid the stability of rotation of the intermediate shaft from being affected, the power transmission device may be connected through the second connecting shaft 107, that is, the power transported to the driving drum is transmitted through the second connecting shaft 107, and specifically, the driving bevel gear 106 may be fixed on the second connecting shaft 107.

During the operation of the unpowered docking transportation device of the present embodiment, the walking wheels 103 are provided at the lower portion of the bracket, and it is possible that a plurality of devices may be used in combination. Accordingly, in order to transmit the rotation power stably down, the structure of docking portion can be varied.

Preferably, the docking portion of the head end of the through-shaft is an outer hexagonal docking portion, the docking portion 108 of the tail end of the through-shaft is an inner hexagonal docking portion, and the outer hexagonal docking portion cooperates with the inner hexagonal docking portion. That is, when the adjacent two unpowered docking transportation devices are connected, the docking portion of the head end of the through-shaft of the next unpowered docking transportation device may be inserted into the docking portion of the tail end of the through-shaft of the previous unpowered docking transportation device, thus achieving power transmission. Of course, the docking portions may employ other structures, and it should be especially noted that all the existing coupling can realize the docking function of the present embodiment, and the docking portion of the embodiments of the present invention may employ any docking structure besides the above mentioned embodiment.

In addition, when docking, since the through-shaft of the previous unpowered docking transportation device is rotating at high speed, and the through-shaft of the next unpowered docking transportation device is in stationary state, if they are docked directly, strong collision may occur between the previous through-shaft and the next through-shaft, easily damaging the unpowered docking transportation devices. In order to improve the stability of the docking, an auxiliary power device may be used to connect to the through-shaft of the next unpowered docking transportation device. Then the auxiliary power device is activated, making the next through-shaft rotating, until the difference between the rotation speed of the next through-shaft and the rotation speed of the previous through-shaft is within a predefined range, making the next through-shaft dock docked with the previous through-shaft, thus improving the stability of the docking.

The belt transporter of the present embodiment may not be provided with a power apparatus, and of course may be provided with a power apparatus, however for cost saving, preferably the power apparatus is not provided. As to the particular structure of the transporter, it further comprises a driven drum 112 and a plurality of belt supporting rollers 110. The driven drum 112 cooperates with the driving drum 109 via a belt 111, and the plurality of belt supporting rollers 110 are arranged along the moving direction of the belt 111. That is, after the rotation power is transmitted to the driving drum 109, the driving drum 109 drives the belt 111 to move, the movement of the belt 111 drives the materials to move. In addition, the plurality of belt supporting rollers 110 are arranged along the moving direction of the belt, making the surface of the belt for transporting the materials remaining in a same plane, avoiding the materials accumulation on the belt due to belt depression.

Figure 1:
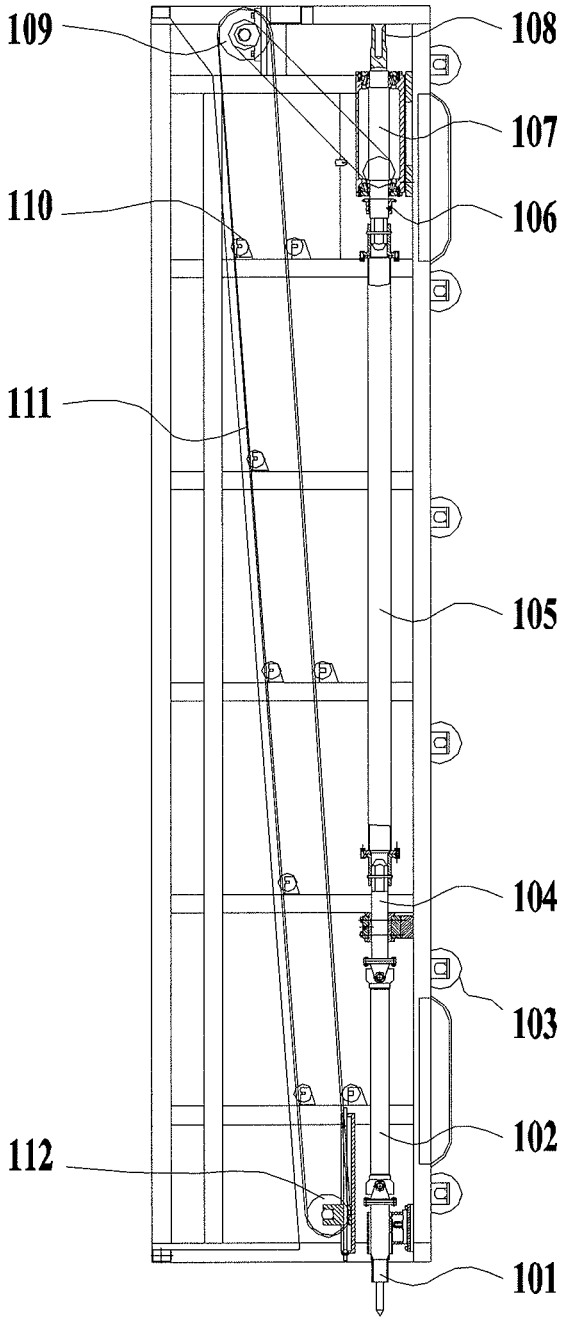
FIG. 1 shows a structural schematic view of an unpowered docking transportation device according to an embodiment of the present invention.
Figure 2:
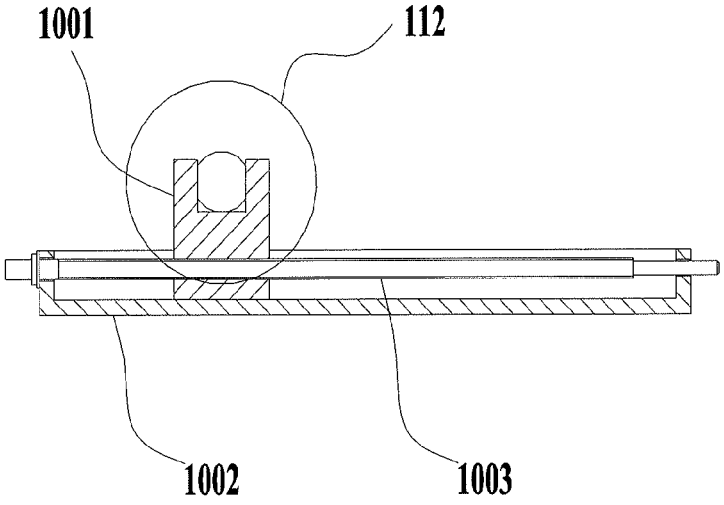
FIG. 2 shows a mounting structural view of a follower roller according to an embodiment of the present invention.

Because the belt will relax after being used for a period of time, in order to make the belt tensioned always, further, as shown in FIG. 2, the transporter further comprises a driven drum seat 1002, a tension screw 1003 and a tension nut 1001. The driven drum seat 1002 is fixed on the bracket of the transporter, and the tension screw 1003 runs through the driven drum seat 1002 along the arrangement direction of the belt. The tension nut 1001 is fixedly connected to the driven drum 112, and the tension nut 1001 cooperates with the tension screw 1003. Specifically, the tension screw is rotated, the tension nut is made to move along the axial direction of the tension screw, since the tension nut is fixed to the driven drum seat, the driven drum seat can move along with the tension nut, thus adjusting the distance between the driven drum and the driving drum, and further adjusting the tension degree of the belt. In addition, the transporter may also employ any other forms of tension, such as a tension wheel.

When a plurality of the above mentioned unpowered docking transportation devices are docked, the two adjacent unpowered docking transportation devices are arranged end to end and docked through the docking portions at the ends of the through-shafts of them, respectively. Specifically, a plurality of the unpowered docking transportation devices are arranged in line and connected end to end, the through-shaft of each unpowered docking transportation device is docked with the through-shafts of the previous and the next ones, and the driving drum of the previous unpowered docking transportation device is located above the driven drum of the next unpowered docking transportation device. The unpowered docking transportation system may be applied to an slope mining machine. The slope mining machine is docked with the first unpowered docking transportation device, the rotation power is transmitted to each of the following unpowered docking transportation devices by a hydraulic motor provided in the slope mining machine, and the mineral cut by the slope mining machine is transported out by the unpowered docking transportation system.

Further, the unpowered docking transportation system further comprises an auxiliary power device which is configured to transmit the rotation power to the through-shaft of the next unpowered docking transportation device when two unpowered docking transportation devices are docking, so that the difference between the rotation speed of the through-shaft of the next unpowered docking transportation device and the rotation speed of the through-shaft of the previous unpowered docking transportation device is within a predefined range. That is, the auxiliary power device is connected to the through-shaft of the next through-shaft of the next unpowered docking transportation device, then the auxiliary power device is activated, making the next through-shaft rotating, until the difference between the rotation speed of the next through-shaft and the rotation speed of the previous through-shaft is within the predefined range, then making the next through-shaft docked with the previous through-shaft, thus improving the stability of the docking, wherein the predefined range may be 0.1~5% of the rotation speed of the previous unpowered docking transportation device, i.e. the speed difference is within 0.1~5% of the rotation speed of the previous through-shaft, thus the docking of the two unpowered docking transportation devices (front one and rear one) may be achieved without shutdown. It should be noted that, in the existing transportation system, when two transportation devices (front and rear) are docked, since the transportation system is provided with power by a rear end power device, the rear end power device must be dismounted from the last transportation device such that the docking can be achieved by shutting down the transportation system. However, the unpowered docking transportation system of the embodiment of the present invention is provided with power by a front end power device, it is only needed to use the auxiliary power device to accelerate the unpowered docking transportation device to be docked to have the rotation speed substantially same to that of the last unpowered transportation device, and thus the docking may be achieved without shutdown, with good stability and high production efficiency.

Preferably, the docking portions at the two ends of the through-shafts of the two adjacent unpowered docking transportation devices are docked through a docking sleeve, wherein the docking sleeve is located at one end of the through-shaft of the previous unpowered docking transportation device and positioned by a pin shaft, and the other end of the docking sleeve is sleeved over the through-shaft of the next unpowered docking transportation device.

The unmanned intelligent mining machine must keep traveling in straight line during the advancing or retreating process. However, when the cutting drum cuts the orebody, since the cutting drum is subject to pressure in different directions applied from the orebody, the unmanned intelligent mining machine is liable to deviate from the advancing direction during the process of traveling. Accordingly, in order to ensure the unmanned intelligent mining machine to travel in straight line, a plurality of groups of distance detection devices and hydraulic supporting rods are provided on both sides of the cutting part body. The plurality of groups of distance detection devices are used to detect the distance from both side walls of the roadway, wherein if the difference between the distances from both sides is greater than a predefined value, the hydraulic supporting rods at the side of smaller distance extend and abut against the side wall of the roadway, and thus the direction of the cutting part is corrected by reaction force.

Specifically, the distance detection devices 214 detect the distance between the unmanned intelligent mining machine and both side walls of the roadway at the fixed time interval, and when the difference between the distances from both sides is detected as greater than the predefined value, it indicates that the unmanned intelligent mining machine deviates from the original direction, and at this time the hydraulic supporting rods 212 at the side of relatively smaller distance extend to the side wall of the roadway, the hydraulic supporting rods 212 always abut against the side wall of the roadway during the advancing or retreating process of the unmanned intelligent mining machine, then the cutting drum can be adjusted continuously back to the original direction by reaction force during the process of cutting, thus ensuring the unmanned intelligent mining machine to keep traveling in straight line.

Due to the existence of various rocks and other debris in a mine, if the rocks are too much or too hard, it is liable to damage the cutting drum of the unmanned intelligent mining machine. Furthermore, depending on different working conditions, the unmanned intelligent mining machine should employ different working states. Accordingly, the unmanned intelligent mining machine is also provided with a visual detection system. The visual detection system may utilize infrared thermal imaging principle to produce an infrared image with lithology distribution on the working surface and temperature change when the mineral contacts with the cutting teeth, etc., and transmit to an operation screen, and the operator targetedly adjusts working parameters under working conditions, such as different lithology, structure, occurrence and the like, by means of the analysis on the infrared image. Thus, the unmanned intelligent mining machine is adapted for orebodies in different working conditions.

A set of electric control system is also provided in the unmanned intelligent mining machine. The control system of mining and backstoping operations adopts both automatic and manual ways, wherein when normal mining, the automatic control mode operation is adopted; and when special circumstances, such as the lithology and geological conditions being changed, backward backstoping and the like are encountered, the manual intervention mode operation is adopted. The backward speed is determined by measuring the force applied to the deployable flank cutting mechanism. According to monitoring the pressure variation of the hydraulic motor and each part of the pipeline, all data of the motor are adjusted in good time.

During the advancing process of the unmanned intelligent mining machine, the cutting part body is firstly moved forward to a predefined position and located in this position, then the reciprocating telescoping device drives the cutting drum to advance, so that the cutting drum cuts the orebody in front of it in up and down direction during advancing, and the mineral dropping down during cutting is collected and delivered outside the mine by the unmanned intelligent mining machine. After the cutting drum extends by a predefined length, the cutting part body is again stationary after advancing for a certain distance, and then the cutting drum is again driven by the reciprocating telescoping device, so that the cutting drum cuts the orebody in front of it in up and down direction during advancing, and so forth until the cutting reaches the end point.

It should be noted that, the cutting drum is provided at the front of the unmanned intelligent mining machine, and the cutting way of up and down repeatedly swaying is adopted, so that during the mining process of straight line, the minimum cross-sectional area is maintained, ensuring safety. After the unmanned intelligent mining machine starts backward backstoping operation after mining to a designed depth, the cutting drum is driven to raise and cut upwardly by the reciprocating telescoping device, and a maximum cutting height is achieved within a reciprocating telescoping distance, and at the same time, at both sides of the sliding stage, the flank cutting drums cut the orebodies on both sides to form a broad free surface in the horizontal direction, making the orebody caving naturally, and improving backstoping efficiency. Then after the flank cutting drums retreat for a fixed distance, the cutting part body retreats, the backstopping action be repeated like this, until the cutting part body is gradually retreated to the design position.

The above is merely preferable embodiments of the present invention and not used to limit the present invention. For one skilled in the art, various modifications and changes may be made to the present invention. Any amendments, replacements and improvements and so on should be covered by the protection scope of the present invention, without departing from the spirit and principle of the present invention.

What is claimed is:

1. An unmanned intelligent mining machine, characterized in that it comprises a cutting part body, a reciprocating telescoping device and a deployable flank cutting device, a cutting part body comprising flanks and a rail;

a sliding stage connected to the cutting part body, the sliding stage comprising a reciprocating telescoping device housed therewithin, for driving a cutting drum to reciprocate back and forth along a reciprocating direction, the sliding stage comprising a second telescoping device and a swing arm for raising and lowering the cutting drum independently of the reciprocating telescoping device, a sliding slot slidably coordinating with the rail of the cutting part body to slide the cutting part body with respect to the sliding stage in a guided manner;

a deployable flank cutting device, being deployable toward the flanks of the cutting part body for cutting an orebody in the direction of the flanks, the deployable flank cutting device comprising:

a flank cutting drum having a generally elongate shape with a longitudinal axis the longitudinal axis being parallel to the reciprocating direction when the deployable flank cutting device is not deployed, cutting teeth positioned spirally on an outer surface of the flank cutting drum, a hydraulic motor provided within the flank cutting drum for rotating the flank cutting drum about the longitudinal axis, the hydraulic motor permitting operation of the deployable flank cutting device independently of the operation of the cutting drum, a flank telescoping device for extending or retracting the flank cutting drum independently of the reciprocating telescoping device, such that when the flank telescoping device extends the flank cutting drum into an extended position along the longitudinal axis, the flank cutting drum pivots about the flank telescoping device to form an angle relative to the reciprocating direction; and a sliding plate located at lower portion of front end of the sliding stage and abutting against the ground in the mine, the sliding plate being positioned to one side of a transverse centerline of the sliding stage so as to withstand pressure from the cutting drum, thereby reducing deformation of the sliding stage.

2. The unmanned intelligent mining machine according to claim 1, characterized in that the reciprocating telescoping device further comprises first power device;

the sliding stage slidably coordinates with the cutting part body, the first power device is fixed on the cutting part body and is configured to drive the sliding stage to slide, and the cutting drum is disposed on the sliding stage.

3. The unmanned intelligent mining machine according to claim 2, characterized in that the deployable flank cutting device comprises a flank power device for driving the deployable flank cutting device to be deployed toward two opposite sides of the sliding stage to a position forming a certain angle with a longitudinal direction of the sliding stage.

4. The unmanned intelligent mining machine according to any one of claims 1 to 3, characterized in that a plurality of groups of distance detection devices and hydraulic supporting rods are provided on both sides of the cutting part body respectively;

the plurality of groups of distance detection devices are used to detect the distance from both side walls of the roadway, wherein if the difference between the distances from both sides is greater than a predefined value, the hydraulic supporting rods at the side of smaller distance extend and abut against the side wall of the roadway, and thus the direction of the cutting part body is corrected by reaction force.

5. The unmanned intelligent mining machine according to any one of claims 1 to 3, characterized in that it further comprises a plurality of unpowered docking transportation devices, each unpowered docking transportation device comprising a transporter, a through-shaft and a power transmission device;

the through-shaft runs through the unpowered docking transportation devices, and both ends of the through-shaft are provided with docking portions for docking with the cutting part body and/or the previous unpowered docking transportation device and/or the next unpowered docking transportation device; and the power transmission device is used to transmit the rotation power from the through-shaft to the transporter.

* * * * *